US010994919B2

(12) United States Patent
Hochberg et al.

(10) Patent No.: US 10,994,919 B2
(45) Date of Patent: May 4, 2021

(54) PACKAGE WITH INTEGRATED MAGNETIC VALVE

(71) Applicant: The Procter & Gamble Company, Cincinnati, OH (US)

(72) Inventors: Scott David Hochberg, Cincinnati, OH (US); Kenneth Stephen McGuire, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/535,118

(22) Filed: Aug. 8, 2019

(65) Prior Publication Data

US 2020/0055659 A1 Feb. 20, 2020

Related U.S. Application Data

(60) Provisional application No. 62/718,403, filed on Aug. 14, 2018.

(51) Int. Cl.

| | |
|---|---|
| ***B65D 83/00*** | (2006.01) |
| ***B65D 75/28*** | (2006.01) |
| ***B65D 75/58*** | (2006.01) |

(52) U.S. Cl.

CPC ..... *B65D 83/0055* (2013.01); *B65D 75/28* (2013.01); *B65D 75/5822* (2013.01)

(58) Field of Classification Search

CPC .... B65D 83/0055; B65D 33/24; B65D 75/28; B65D 75/58; B65D 2313/04; A41F 1/002

See application file for complete search history.

(56) References Cited

U.S. PATENT DOCUMENTS

| | | | |
|---|---|---|---|
| 3,968,898 | A | 7/1976 | Beer |
| 5,027,966 | A | 7/1991 | Yadock |

(Continued)

FOREIGN PATENT DOCUMENTS

| | | | |
|---|---|---|---|
| CN | 2693663 | Y | 4/2005 |
| CN | 105644924 | A | 6/2016 |

(Continued)

OTHER PUBLICATIONS

International Search Report and Written Opinion dated Nov. 19, 2019, PCT/US2019/045594, 11 pgs.

(Continued)

*Primary Examiner* — J C Jacyna
(74) *Attorney, Agent, or Firm* — Sarah M DeCristofaro

(57) ABSTRACT

A package for dispensing a fluent material contained in the package. The package can include a first polymeric sidewall having a first perimeter and a second polymeric sidewall having a second perimeter, the first and second polymeric sidewalls being joined at least along a portion of the first and second perimeters to define a flexible pouch having an interior compartment for a contained fluent material in an equilibrium pressure state. An opening permits fluid communication through the first opening upon the contained fluent material being in a positive pressure state greater than the equilibrium pressure state. The opening can have a magnetic valve, the magnetic valve having a first magnetic region and an opposing second magnetic region. The first magnetic region and second magnetic region can be in a separable magnetically contacting state to alternately permit and prevent fluid communication of the fluent material.

17 Claims, 10 Drawing Sheets

(56) References Cited

U.S. PATENT DOCUMENTS

| | | | | |
|---|---|---|---|---|
| 5,294,022 | A * | 3/1994 | Earle | B67D 3/0003 141/114 |
| 5,424,703 | A | 6/1995 | Blume, Jr. | |
| 5,428,332 | A | 6/1995 | Srail | |
| 5,505,305 | A | 4/1996 | Scholz | |
| 6,397,560 | B1 | 6/2002 | Weder | |
| 6,640,991 | B1 | 11/2003 | Amanat | |
| 6,749,551 | B2 | 6/2004 | Metzler et al. | |
| 7,128,798 | B2 | 10/2006 | Boudouris | |
| 7,178,185 | B1 | 2/2007 | Nattler | |
| 8,556,876 | B2 | 10/2013 | Beckman | |
| 9,062,222 | B2 | 6/2015 | Nilsson | |
| 9,305,598 | B2 | 4/2016 | Rossiter | |
| 9,533,786 | B1 | 1/2017 | Feinstein | |
| 2002/0027138 | A1 | 3/2002 | Hyobu | |
| 2003/0142887 | A1 | 7/2003 | Sleight | |
| 2003/0218525 | A1 | 11/2003 | Sugawara | |
| 2004/0001973 | A1 | 1/2004 | Gao | |
| 2004/0241394 | A1 | 12/2004 | Burrows | |
| 2005/0056655 | A1 | 3/2005 | Gary | |
| 2005/0230465 | A1 | 10/2005 | Metzler | |
| 2005/0242097 | A1 | 11/2005 | Morin | |
| 2005/0285749 | A1 | 12/2005 | Schmidt-troschke | |
| 2006/0168767 | A1 | 8/2006 | Huang | |
| 2006/0231562 | A1 | 10/2006 | Carroll | |
| 2006/0283750 | A1 | 12/2006 | Villars | |
| 2010/0308039 | A1 | 12/2010 | Miros | |
| 2011/0253571 | A1 | 10/2011 | Rothbaum | |
| 2012/0018428 | A1 | 1/2012 | Norman | |
| 2012/0073242 | A1 | 3/2012 | Nilsson | |
| 2012/0076995 | A1 | 3/2012 | Nilsson | |
| 2012/0103506 | A1 | 5/2012 | Love | |
| 2012/0216374 | A1* | 8/2012 | Manuello | A41F 1/002 24/303 |
| 2013/0032503 | A1* | 2/2013 | Nobile | B65D 77/20 206/494 |
| 2013/0061431 | A1 | 3/2013 | Naftali | |
| 2014/0008425 | A1 | 1/2014 | Clark | |
| 2014/0034080 | A1 | 2/2014 | Paquet | |
| 2014/0093299 | A1 | 4/2014 | Lambert | |
| 2015/0023223 | A1 | 1/2015 | Robbins | |
| 2015/0196955 | A1 | 7/2015 | Naftalin | |
| 2015/0305402 | A1 | 10/2015 | Bourgoin | |
| 2016/0039575 | A1* | 2/2016 | Murray | B65D 75/566 206/204 |
| 2016/0095763 | A1 | 4/2016 | Mazor | |
| 2016/0221722 | A1* | 8/2016 | Burke | B65D 85/18 |
| 2017/0066559 | A1 | 3/2017 | Kim | |
| 2017/0105556 | A1 | 4/2017 | Tarpey | |
| 2017/0159295 | A1 | 6/2017 | Warner | |
| 2017/0275056 | A1* | 9/2017 | Boudouris | B65D 33/24 |
| 2018/0042403 | A1 | 2/2018 | Storace | |
| 2018/0339806 | A1* | 11/2018 | Sugita | B65D 47/2018 |
| 2019/0133281 | A1 | 5/2019 | Munie | |
| 2020/0055635 | A1* | 2/2020 | Hochberg | B65D 33/1616 |
| 2020/0055636 | A1* | 2/2020 | Hochberg | B65D 75/58 |
| 2020/0058430 | A1 | 2/2020 | Hochberg | |

FOREIGN PATENT DOCUMENTS

| | | | |
|---|---|---|---|
| CN | 205998313 | U | 3/2017 |
| DE | 202009000499 | U1 | 3/2009 |
| EP | 741555 | B1 | 12/1997 |
| EP | 665737 | | 12/1998 |
| EP | 1683736 | B1 | 3/2010 |
| EP | 1507659 | B1 | 2/2011 |
| EP | 3038938 | B1 | 10/2018 |
| EP | 2935029 | B1 | 2/2019 |
| EP | 3123489 | B1 | 5/2019 |
| FR | 2680761 | A1 | 3/1993 |
| GB | 1121773 | A | 7/1968 |
| JP | 2015020779 | A | 2/2015 |
| WO | WO2006135313 | A1 | 12/2006 |
| WO | WO2014096427 | A1 | 6/2014 |
| WO | WO2015132025 | A1 | 9/2015 |
| WO | WO2016139170 | A1 | 9/2016 |
| WO | WO2017002139 | A1 | 1/2017 |
| WO | WO201721398 | A1 | 2/2017 |
| WO | WO2017172542 | A1 | 10/2017 |

OTHER PUBLICATIONS

International Search Report and Written Opinion dated Oct. 18, 2019, PCT/US2019/045595, 12 pgs.

International Search Report and Written Opinion dated Oct. 18, 2019, PCT/US2019/045596, 12 pgs.

International Search Report and Written Opinion dated Oct. 23, 2019, PCT/US2019/045597, 12 pgs.

All Office Actions; U.S. Appl. No. 16/535,122.

All Office Actions; U.S. Appl. No. 16/535,119.

* cited by examiner

PACKAGE WITH INTEGRATED MAGNETIC VALVE

FIELD OF THE INVENTION

Embodiments of the technology relate, in general, to packaging having a valve closure for the controlled dispensing of a fluent material.

BACKGROUND OF THE INVENTION

Packaging for dispensing fluent materials like powders and relatively high viscosity fluids such as such as lotions, creams, pastes, and the like, can be challenging. Being able to dispense out an amount of fluent material desired through an opening in a controlled manner and being able to stop the fluid flow at will in a commercially viable manner can be problematic. In addition, dispensing fluent materials can result in the product being contaminated. Fluent dispensers can fail to seal in the fluent material and the product can clog or interrupt the seal during multiple uses. Further, often packaging for dispensing fluent materials requires two-handed operation to open, dispense, and/or close the package.

There remains an unmet need, therefore, for packaging that permits controlled dispensing of fluent materials.

Further, there remains an unmet need for a package capable of dispensing fluent materials that can resist contamination through multiple uses.

Further, there remains an unmet need for a package that can open to dispense fluent materials and subsequently be closed in a one-handed operation.

Additionally, there remains an unmet need for packaging for dispensing a fluid contained in the package that can be manufactured in a commercially viable manner.

DETAILED DESCRIPTION OF THE INVENTION

Figure 1:
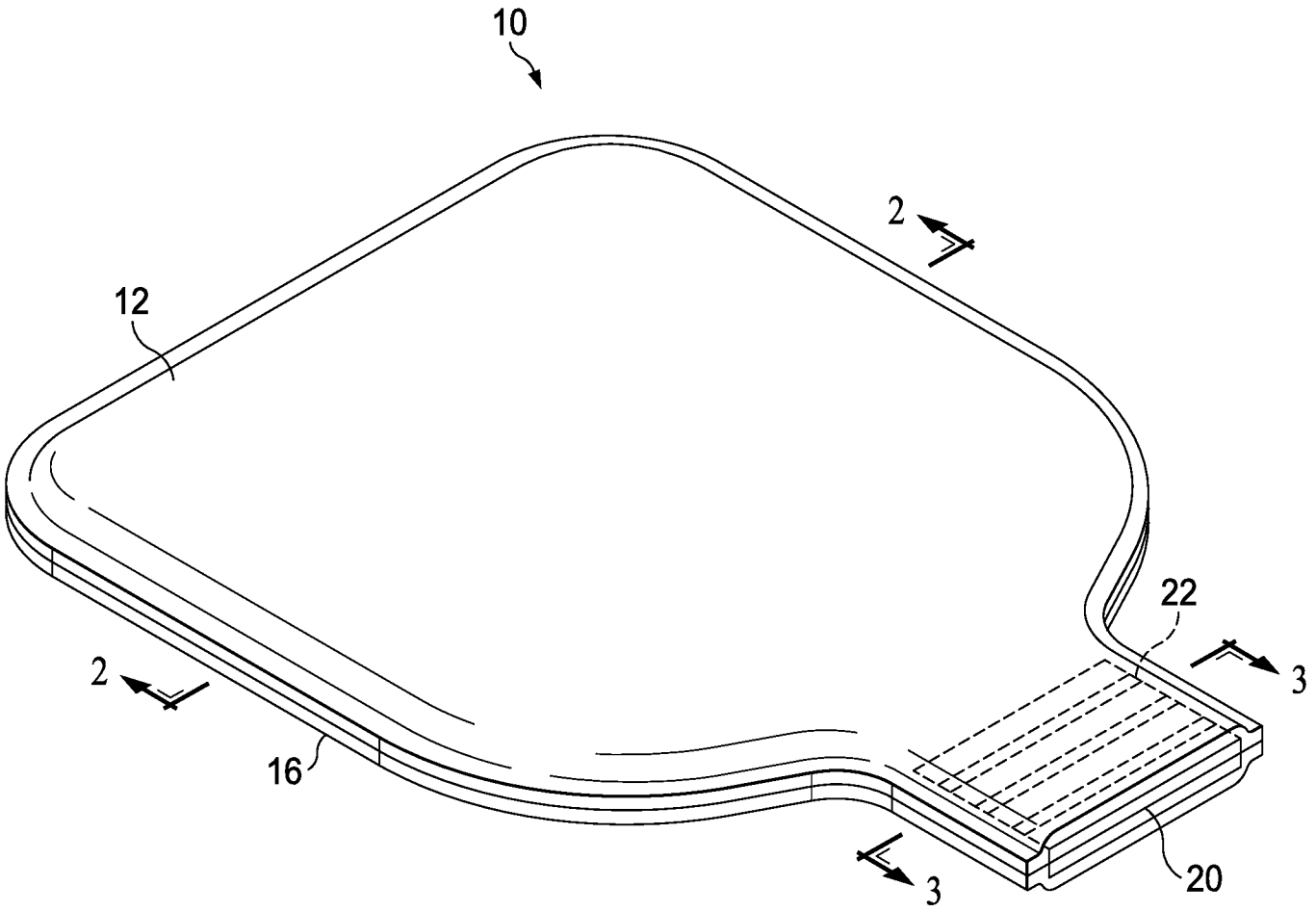
FIG. 1 is a perspective view of an embodiment of a package of the disclosure.

Certain embodiments are hereinafter described in detail in connection with the views and examples of FIGS. 1-19, wherein like numbers refer to like elements throughout the views.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific FIG. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The present disclosure relates generally to packaging having an opening through which fluent materials can be dispensed. Fluent materials are materials that can be poured such as granulated materials, powders (e.g. laundry detergent powder) or fluids. For conciseness, in the present disclosure, the fluent material being described in the embodiments is a fluid. The fluid can be a relatively high density fluid, such as lotions, creams, pastes, and the like. The packaging can be flexible packaging, such as pouches, bags and boxes, which can be made of flexible materials such as polymer films, foil films, laminates, and the like.

Dispensing can be generally accomplished by squeezing, and the embodiments disclosed herein solve the problem of capping and/or uncapping the opening of such a flexible package, and the dispensing can be one-handed. The embodiments disclosed herein can also protect the dispensed fluent from contamination, including after multiple uses. In general, packages of the present disclosure can dispense a fluid through an opening without the need to first remove a lid or cap, and without the need to replace a lid or cap. In general, the packages of the present disclosure can effect dispensing without the need for closures such as lids, caps, zipper closures, fitments, or the like. In general, the packages of the present disclosure can have self-closing openings that can be forced open when the contents of the package experience sufficient pressure to do so, and can close (and in embodiments, seal) when the applied pressure is released. In general, non-limiting embodiments packaging are disclosed herein as flexible packaging. Flexible packaging can include, for example, polymeric sidewalls and can be in the form of squeezable pouches.

In embodiments, the self-closing feature can include magnetic regions under mutual magnetic attraction. Such a feature is referred to herein as a magnetic valve.

The magnetic regions of the flexible packaging can be magnets and can be disposed on a opening portion of the flexible packaging in a manner in which they are mutually attracted. In embodiments, the magnetic regions can be the result of a magnetized material such as a magnetizable ink that has been deposited in a predetermined pattern at the opening portion of the flexible packaging, cured (if necessary), and magnetized. In an embodiment, the magnetizable material can be a magnetic ink magnetized by a process utilizing pairs of mating magnetic arrays in which the magnetic ink is deposited, such as by printing, onto a flexible web substrate and passed through the gap between the mating magnetic arrays. In an embodiment, the flexible web substrate can contact one of the magnetic arrays.

In an embodiment, an apparatus and method for magnetizing a magnetizable material into patterns of north and south poles on a flexible web substrate is disclosed in co-owned, U.S. Pat. Ser. No. 62/718,402 which was filed on the same day as the present disclosure in the name(s) of Scott David Hochberg, and which is hereby incorporated herein by reference.

In an embodiment, a magnetizable material can be deposited, such as by printing or extrusion, onto a polymeric web substrate. Further, the magnetizable material and/or the web substrate having deposed thereon the magnetizable material can be generally planar and continuous on at least two parallel surfaces. In an embodiment, the magnetizable material comprises a magnetic ink available from ACTEGA North America, Delran, N.J., and can comprise a substrate, a primer and magnetic ink. A water-based adhesion assisting primer can be deposited and cured on a substrate, such as a polymer film. A magnetic ink can be deposited on top of the substrate and cured using a UV light source. The magnetic ink can comprise monomers, oligomers, photoinitiators and isotropic neodymium iron boron particles. Multiple layers of the magnetic ink can be used to increase the amount of magnetizable material on the substrate.

Figure 2:
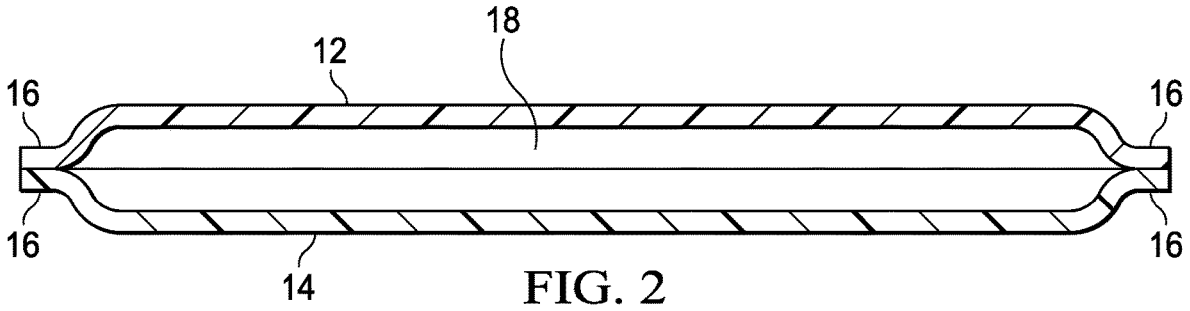
FIG. 2 is a cross-sectional view of Section 2-2 of FIG. 1.

Referring to FIG. 1, there is shown an example of a package 10, which is a flexible package 10 for dispensing a fluid contained in the package. The flexible package 10 can have a first sidewall 12 and a second sidewall 14 (as shown in FIG. 2). Each sidewall 12, 14 can have a perimeter 16. The sidewalls 12, 14 can be joined, such as by adhesive, welding, crimping, or the like to each other at the perimeter 16 to form a container, such as a pouch, having an interior compartment 18 (as shown in FIG. 2) and an opening 20. The interior compartment 18 can be closed when opening 20 is closed, or can have fluid communication with the exterior portions when opening 20 is open. In general, any number of sidewalls can be utilized, but for simplicity, the invention is disclosed herein as having two sidewalls joined about their respective peripheries and forming an opening. Further, the term "sidewall" is not to be taken as suggesting any degree of flatness, shape, size, or thickness.

Figure 3:
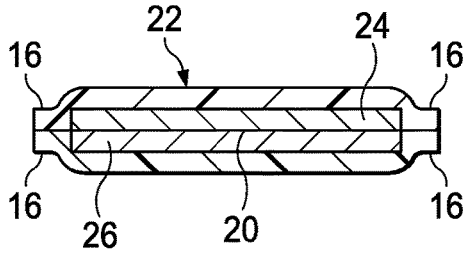
FIG. 3 is a cross-sectional view of Section 3-3 of FIG. 1.

The flexible package 10 can have a magnetic valve 22. Magnetic valve 22 can include two opposing magnetic regions 24 and 26 as indicated in FIG. 3. Magnetic region 24 can be disposed on a portion of first sidewall 12, and magnetic region 26 can be disposed on a portion of second sidewall 14. Magnetic regions 24, 26 can be sized according to the size and shape of the opening 20 and their respective forces of attraction to define a magnetic valve as disclosed more fully herein. Magnetic region can be a magnetized magnetic ink that can be printed onto a region of the package corresponding to the opening 20 and sized and shaped according to the requirements of the fluid being dispensed. In general, magnetic regions 24 and 26 can mirror one another in shape and size, and can be disposed opposite one another in the opening 20 of package 10 and can be in a separable magnetically contacting state. In general, magnetic regions 24 and 26 can, when in a magnetically contacting state can effect closure, and potentially sealing, and in an embodiment sealing completely across the extent of the opening 20 of the flexible package 10.

Figure 4B:
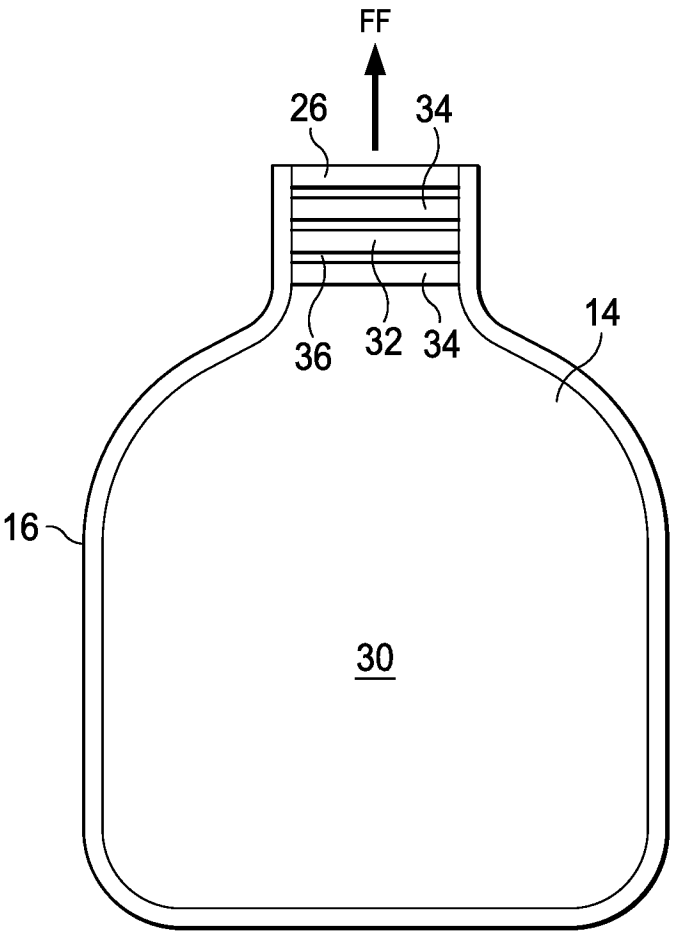
FIG. 4B is side of a portion of a package of the disclosure.
Figure 4A:
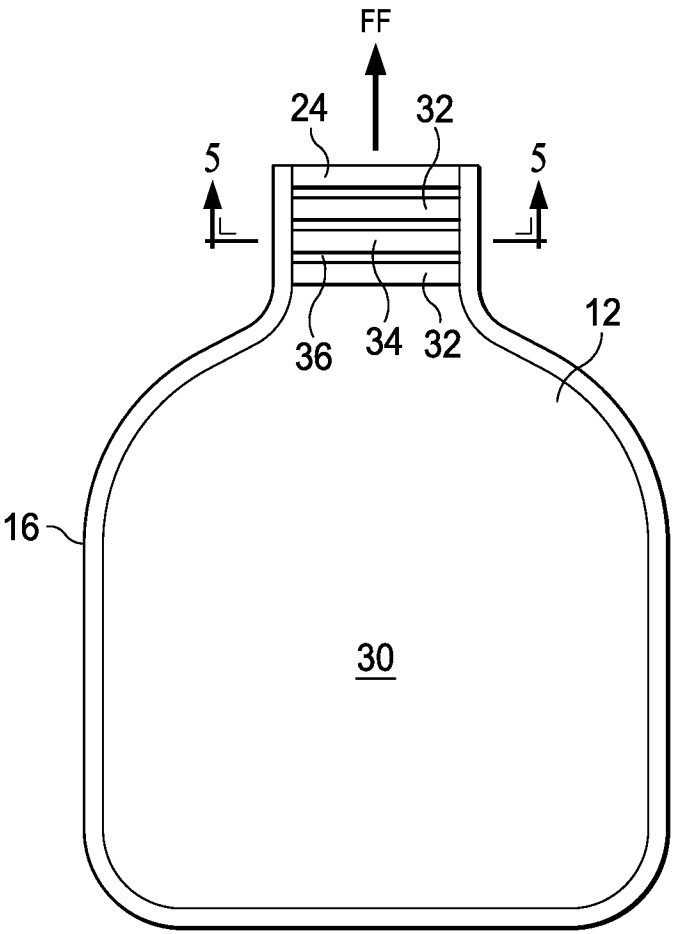
FIG. 4A is side of a portion of a package of the disclosure.

FIG. 4A shows an example of first sidewall 12 and FIG. 4B shows an example of second sidewall 14. FIGS. 4A and 4B show the interior face 30 of each sidewall, as well as first magnetic regions 24 and 26. Magnetic regions 24 and 26 can each comprise a pattern of alternating north pole bands 32 and south pole bands 34 of magnetized material, such as ink, with the bands 32 and 34 being separated by neutral zones 36. In general, the bands can be in a pattern of continuous stripes oriented generally perpendicularly to a direction of desired fluid flow FF. However, the bands or strips of magnetized poles can be oriented parallel to, or at an angle with respect to the direction of desired fluid flow. Likewise, the bands 32 and 34 need not be continuous in the form of stripes, but can be a band-like feature comprising discrete circular-shaped, oval-shaped, rectangular-shaped, and the like portions of magnetized material.

Figure 5:
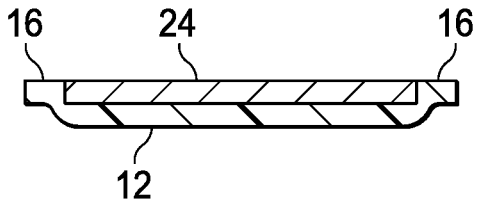
FIG. 5 is a cross-sectional view of Section 5-5 in FIG. 4A.

As shown in FIG. 5, opening 20 can be configured such that the magnetized material of the magnetic region 24 can be generally flush with a perimeter portion 16 of a sidewall 12. In this manner, better closing, and potentially sealing, can best be achieved.

Figure 6:
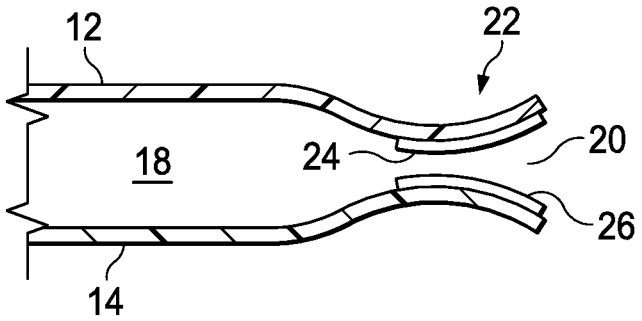
FIG. 6 is partial cut-away view of a portion of an opening of a package of the disclosure.
Figure 7:
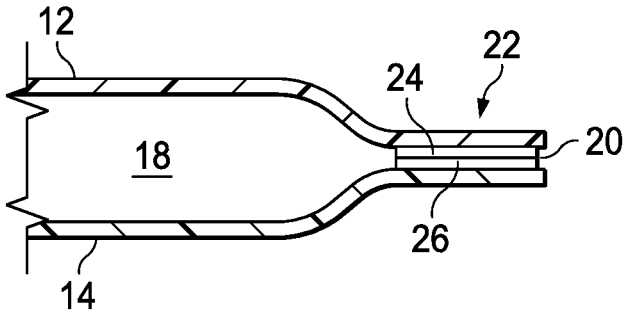
FIG. 7 is partial cut-away view of a portion of an opening of a package of the disclosure.
Figure 8:
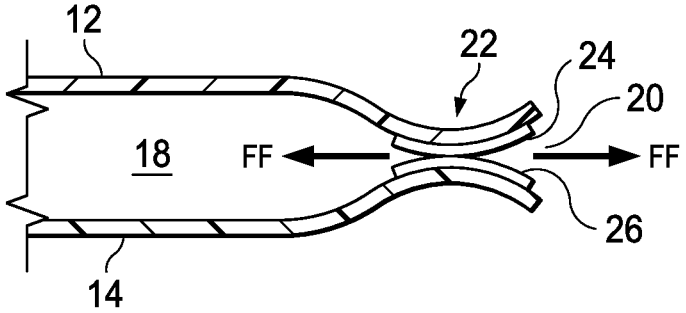
FIG. 8 is partial cut-away view of a portion of an opening of a package of the disclosure.

FIGS. 6-8 illustrate in schematic partial cut-away view an advantage of an embodiment of a magnetic valve of the present disclosure. Magnetic regions 24 can be flexible, and can be as flexible as the polymer material of the sidewall 12, 14. Magnetic regions 24 can comprise magnetic ink deposited, such as by printing, in a relatively thin layer, such that the portions of sidewalls 12 and 14 that form opening 20 can be generally flexible, and can be flexibly magnetically attracted to one another.

FIG. 6 illustrates the opening 20 in an open state with magnetic region 24 on sidewall 12 being separated from magnetic region 26 on sidewall 14 such that the interior compartment 18 can be in fluid communication with the exterior of the package 10 through opening 20.

FIG. 7 illustrates the opening 20 in a closed state with the magnetic region 24 on sidewall 12 being in a separable magnetically contacting state with the magnetic region 26 on sidewall 14 such that the interior compartment 18 is not in fluid communication with the exterior of the package 10 through opening 20.

An open state can occur, for example, if fluid contents contained in interior compartment 18 experience pressure from the sidewalls of the flexible package being compressed toward one another and, due to the pressure increase, force open the separable magnetically contacting magnetic regions 24 and 26. Once opening 20 is forced open, fluid contents can exit the flexible package 10 through opening 20.

FIG. 8 illustrates how opening 20 can close when pressure from the sidewalls is decreased or removed such that fluid contained in interior compartment 18 is no longer under sufficient pressure to exit opening 20. As shown, magnetic region 24 can be attracted to magnetic region 26, and the attraction can occur such that fluid is squeezed from the interface in one or both of two desired fluid flow directions FF. Fluid can be squeezed back into the interior compartment 18, or fluid can be squeezed out of the opening 20 to the exterior of the flexible package 10.

As illustrated in FIGS. 6-8, opening 20 can be considered a magnetic valve 22, alternately permitting and preventing fluid communication of a contained fluid through the opening 20. The magnetic valve 22 can be described as pressure activated. When the magnetic valve 22 is closed, a fluid contained inside the interior compartment 18 can be in a first pressure state, the first pressure state being insufficient to force fluid through opening 20. This first pressure state can be considered an equilibrium pressure state, even though, in fact, the fluid may be under a measurable amount pressure. If the fluid contained inside the interior compartment 18 experiences a second, greater, pressure state that is sufficient to overcome the separable magnetically contacting state of magnetic regions 24 and 26, the second pressure state can result in non-equilibrium such that the fluid exits the flexible package 10 through opening 20. Upon the fluid experiencing a third pressure state, less than the second pressure state and insufficient to maintain separation of magnetic regions 24 and 26, the magnetic regions 24 and 26 can once again be in a separable magnetically contacting state and opening can be closed. The third pressure state then becomes a new equilibrium first pressure state for another cycle of fluid dispensing and magnetic valve operation. Again, in this manner, the magnetic valve 22 alternately permits and prevents fluid communication of the contained fluid through the opening 20.

In an embodiment, the magnetic holding force can be such that the first pressure state is greater than a pressure state experienced if a package is lifted and/or held by a human hand during normal use. That is, in an embodiment, a package of the present disclosure can be held without dispensing, and dispensing does not occur until a second pressure state occurs, such as by squeezing.

Figure 9:
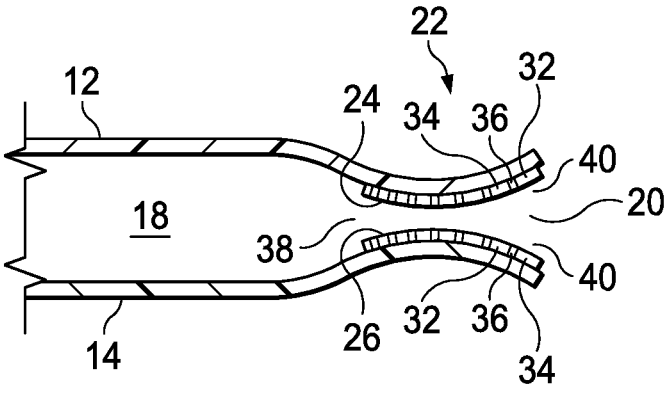
FIG. 9 is partial cut-away view of a portion of an opening of a package of the disclosure.
Figure 10:
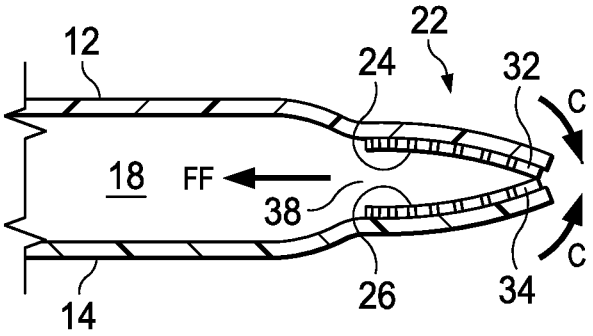
FIG. 10 is partial cut-away view of a portion of an opening of a package of the disclosure.

FIGS. 9 and 10 illustrate in schematic partial cut-away view another advantage of an embodiment of a magnetic valve 22 of the present disclosure. As discussed above, magnetic regions 24 and 26 can each comprise a pattern of alternating north pole bands 32 and south pole bands 34 of magnetized material, such as ink, with the bands 32 and 34 being separated by neutral zones 36. Magnetic regions 24 can be flexible, and can be substantially as flexible as the polymer material of the sidewall 12, 14. Magnetic regions 24 can comprise magnetic ink deposited, such as by printing, in a relatively thin layer and magnetized to form generally linearly oriented, substantially parallel bands of magnetic poles. In the illustrated embodiment, a pattern of generally linearly oriented bands of alternating magnetic poles is oriented such that the poles run perpendicular to the direction of desired fluid flow FF, which as illustrated can be considered "into the page" of the two-dimensional representations of FIGS. 9 and 10.

In general, north pole bands of magnetic region 24 can be attracted to south pole bands of magnetic region 26 so that magnetic region 24 is magnetically attracted to magnetic region 26 and can cause magnetic region 24 to be in a separable magnetically contacting state with magnetic region 26.

In the embodiment shown in FIGS. 9 and 10, the generally linearly oriented, substantially parallel bands of magnetic poles exhibits a pattern in which the width and spacing of adjacent bands decreases such that the bands of alternating north poles 32 and south poles 34 have relatively less width and/or are more closely spaced at a proximal portion 38 of the opening 20. Likewise, the bands of alternating north poles 32 and south poles 34 have relatively greater width and/or are less closely spaced at a distal portion 40 of the opening 20. The change in spacing, i.e., in pole density, can create a magnetic flux gradient. A pole density gradient is achieved with a variation in the width of the bands of magnetic poles in the direction planar and perpendicular to the band. Likewise a magnetic flux gradient is the integral of the normal component of the magnetic field passing through a defined surface. For printed magnetic materials, that surface is planar to the working face of the magnetized material. The gradient of the magnetic flux is to say that the integral of the normal component of the magnetic field from the magnetized region is non-constant at that surface. A flux gradient can be achieved by creating a pole width gradient (i.e., varying the poles-per-inch), or by varying the magnetic material thickness.

When the generally linearly oriented, substantially parallel bands of magnetic poles exhibits a pattern as described and shown in FIGS. 9 and 10, the magnetic flux profile is relatively higher at the proximal portion 38 of opening 20, resulting in a relatively higher magnetic attraction, i.e., holding force but has a relatively lower "reach", i.e., a relatively less magnetic attraction at a distance.

Likewise, when the generally linearly oriented, substantially parallel bands of magnetic poles exhibits a pattern as described and shown in FIGS. 9 and 10, the magnetic flux profile is relatively lower at the distal portion 40 of opening 20, resulting in a relatively lower magnetic attraction, i.e., holding force but a relatively higher "reach", i.e., a relatively higher magnetic attraction at a distance.

As shown in FIG. 10, the magnetic pole pattern described with respect to FIG. 9 can result in the distal portion 40 of opening 20 experiencing a closing motion as indicated by arrows C relatively sooner than does the proximal portion 38. In this manner, the distal end 40 of opening 20 can close first due to the greater reach of the magnetic flux, but may contact with a relatively weaker magnetic force. As magnetic region 24 contacts magnetic region 26 at distal portion 40, the magnetic attraction can continue with contact occurring in a direction toward the proximal portion 38 in which the magnetic flux density is relatively less, but the magnetic holding force is relatively greater.

As can be understood from the description herein, a magnetic valve having the configuration described with respect to FIGS. 9 and 10 can act as a one-way "pump" to force any fluid in the opening 20 back into the interior compartment 18 in the direction of desired fluid flow FF during magnetic valve 22 closure. Alternately, the magnetic valve can have an opposite configuration of variable magnetic force, such that the one-way pump forces fluid out of the flexible package 10 opening 20 upon closure of the magnetic valve 22. In this manner, it is possible to prevent fluent materials from becoming trapped in the magnetic region and potentially weakening the magnetic holding force. In general, the first magnetic region and second magnetic region can be in a variable magnetic force separable magnetically contacting state to alternately permit and prevent fluid communication of the contained fluid through the magnetic valve of the opening.

Figure 11:
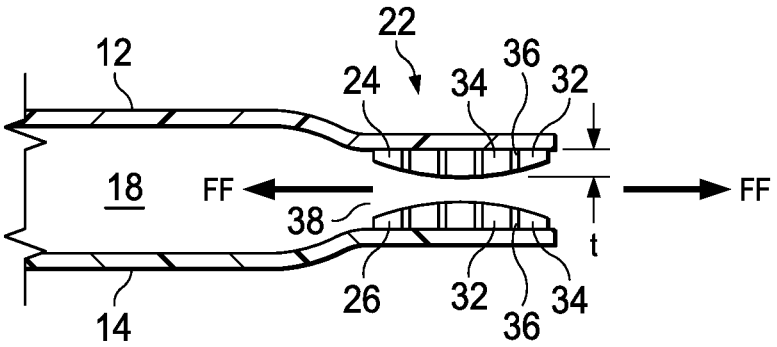
FIG. 11 is partial cut-away view of a portion of an opening of a package of the disclosure.
Figure 12:
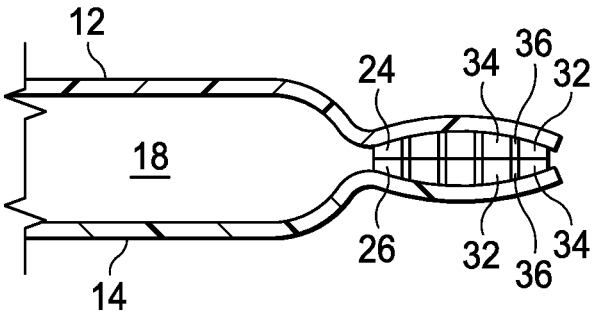
FIG. 12 is partial cut-away view of a portion of an opening of a package of the disclosure.

FIGS. 11 and 12 illustrate in schematic partial cut-away view another embodiment of a magnetic valve 22 of the present disclosure. Magnetic regions 24 and 26 can each comprise a pattern of alternating north pole bands 32 and south pole bands 34 of magnetized material, such as ink, with the bands 32 and 34 being separated by neutral zones 36. Magnetic bands 32 and 34, as well as the neutral zones can be flexible, and can be substantially as flexible as the polymer material of the sidewall 12, 14. Magnetic regions 24 can comprise magnetic ink deposited, such as by printing, in a relatively thin layer and magnetized to form generally linearly oriented, substantially parallel, alternating north and south bands of magnetic poles. In the illustrated embodiment, a pattern of generally linearly oriented bands of alternating magnetic poles is oriented such that the poles run perpendicular to a direction of desired fluid flow FF, which as illustrated can be considered "into the page" of the two-dimensional representations of FIGS. 11 and 12.

As illustrated in FIG. 11, the magnetic regions 24 and 26 can each or both have a variable thickness t, as indicated in FIG. 11 for magnetic region 24. In an embodiment, the magnetic regions can have a length value measured from an edge nearest a proximal portion 38 of opening 20 to an edge nearest the distal portion 40 of opening 20. The variable thickness of the magnetic region, which can be magnetic ink, and which can be considered a thickness gradient, produces a corresponding magnetic force gradient. In the embodiment illustrated, the greatest thickness t is near the midpoint of the magnetic region 24, 26 between the proximal portion 38 and distal portion 40 of opening 20. Because the greatest thickness, and therefore, the greatest magnetic force, is substantially between the proximal portion 38 and distal portion 40, in operation, this portion can tend to be in a magnetically contacting state before the rest of magnetic regions 24, 26, which can, according to the force gradient produced, proceed to a complete, or near complete, contacting state, as depicted in FIG. 12. In closing, the magnetic valve 22 shown in FIGS. 11 and 12 can tend to urge fluid in desired fluid flows FF, as shown in FIG. 11, in which fluid clears the magnetic valve 22 and either is forced into the interior compartment 18, or to the exterior of the flexible package 10.

In each of the embodiments illustrated in FIGS. 9-12, the magnetic valve 22 can be described as pressure activated. When the magnetic valve 22 is closed, a fluid contained inside the interior compartment 18 can be in a first pressure state, the first pressure state being insufficient to force fluid through opening 20. This first pressure state can be considered an equilibrium pressure state, even though, in fact, the fluid may be under a measurable amount pressure. If the fluid contained inside the interior compartment 18 experiences a second, greater, pressure state that is sufficient to overcome the separable magnetically contacting state of magnetic regions 24 and 26, the second pressure state can result in non-equilibrium such that the fluid exits the flexible package 10 through opening 20. Upon the fluid experiencing a third pressure state, less than the second pressure state and insufficient to maintain separation of magnetic regions 24 and 26, the magnetic regions 24 and 26 can once again be in a separable magnetically contacting state and opening can be closed. The third pressure state then becomes a new equilibrium first pressure state for another cycle of fluid dispensing and magnetic valve operation. Again, in this manner, the magnetic valve 22 alternately permits and prevents fluid communication of the contained fluid through the opening 20.

In an embodiment, the magnetic valve 22 can be protected for shipping and storage by a frangible portion, the frangible portion being a portion that can be torn off, split off, broken off, twisted off, pulled off, or otherwise removed from the flexible package 10 so that the magnetic valve 22 can alternately permit and prevent fluid communication of the contained fluid through the opening 20. The frangible portion 44 can, when not removed, cause the flexible package to be sealed from environmental elements, and can prevent the magnetic valve 22 from permitting fluid flow through opening 20 when the package is pressured from the outside, such as by squeezing. Thus, in an embodiment, frangible portion 44 can be an integral part of flexible package 10 that completely encloses a fluid in the interior compartment 18, and which prevents fluid from leaving the interior compartment 18 until it is removed.

Figure 14:
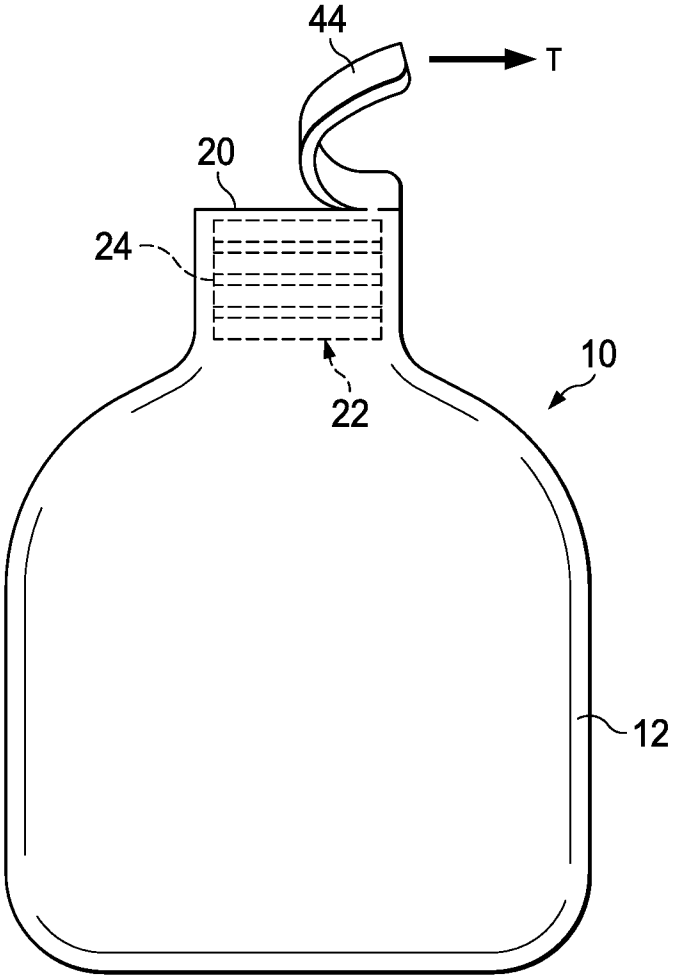
FIG. 14 is side view of a package of the disclosure.
Figure 13:
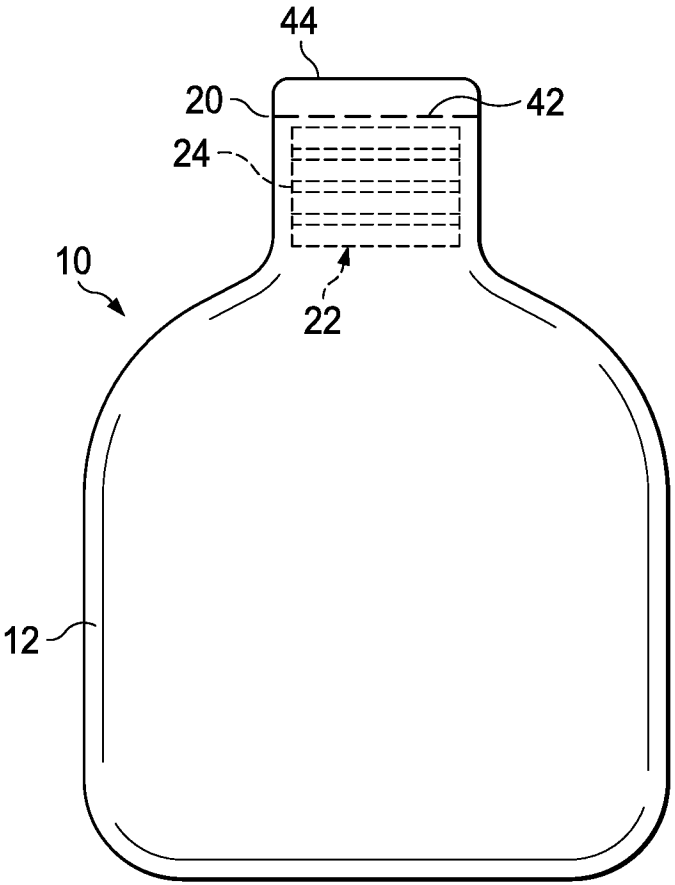
FIG. 13 is side view of a package of the disclosure.

A non-limiting embodiment of a frangible portion 44 is shown in FIGS. 13 and 14. FIG. 14 shows a flexible package 10 that can be a flexible, compressible pouch for dispensing a fluid, such as a lotion, paste, or the like. Flexible package 10 can have a line of weakness 42 at opening 20. In an embodiment the line of weakness 42 can be a perforated line that separates the frangible portion 44 from the remainder of the flexible package 10. As shown in FIG. 14, the frangible portion 44 can be removed, such as by pulling by hand in the direction of tearing T to cause the perforated line to tear and the frangible portion 44 to be removed. Line of weakness 42 need not comprise complete perforations, but can be any line of weakness as is known in the art for the purpose of having a tear-off portion of a flexible package.

Once the frangible portion 44 is removed, the opening 20 can be exposed and the magnetic valve 22 can operate as described herein.

Figure 16:
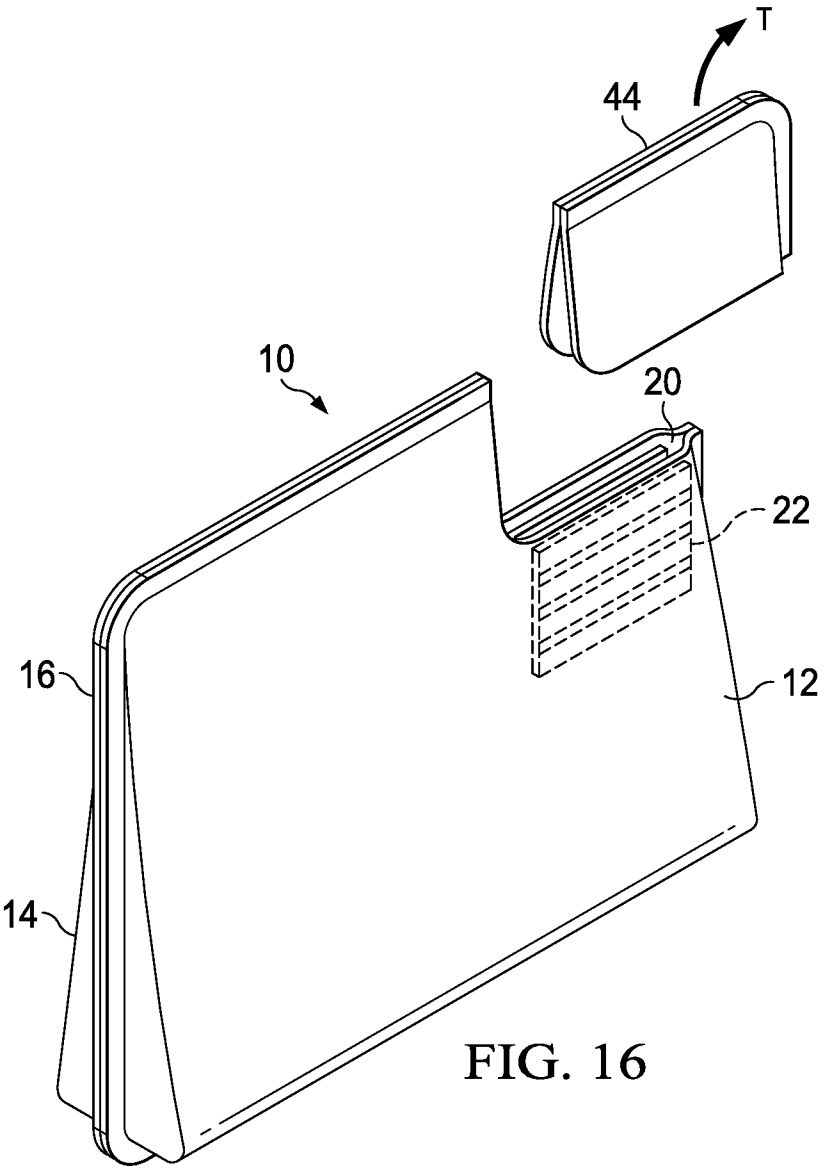
FIG. 16 is a perspective view of a package of the disclosure.
Figure 15:
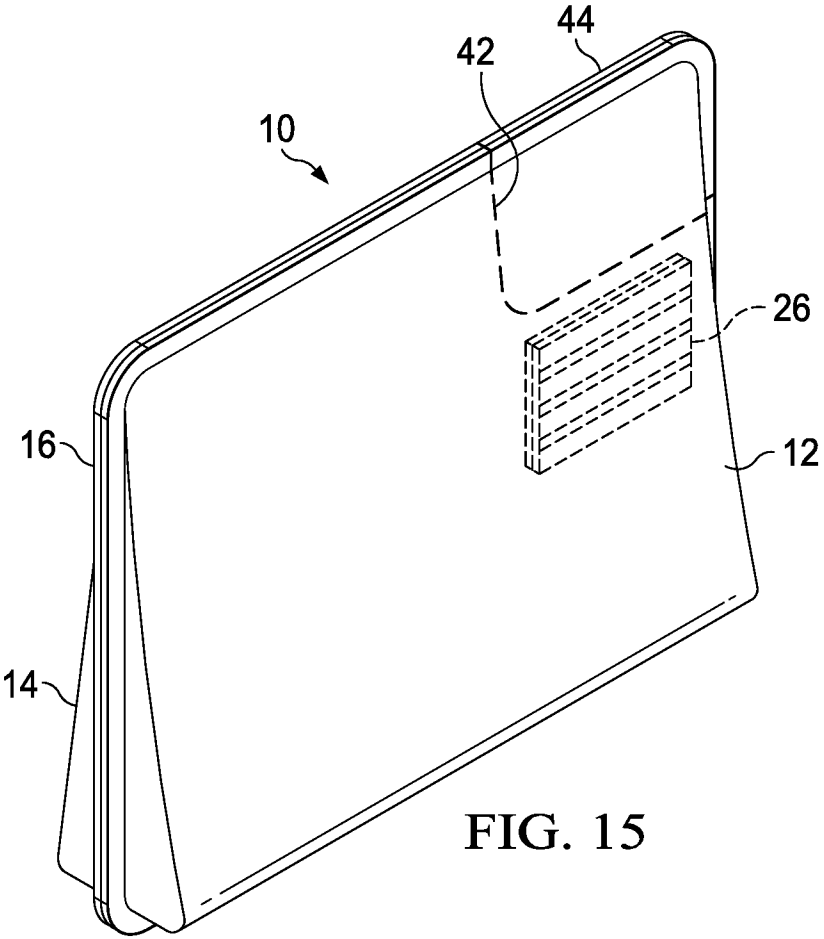
FIG. 15 is a perspective view of a package of the disclosure.

The flexible package 10 need not have any specific shape, and the shapes illustrated are non-limiting examples only. Likewise, the opening 20 and magnetic valves need not have any particular shape, and the shapes illustrated are non-limiting examples only. By way of example of a different package form, FIGS. 15-17B illustrate a flexible package 10 having a frangible portion 44 that can be removed by tearing along a line of weakness 42 in the tearing direction T. As shown in FIGS. 15 and 16, the opening 20 can be asymmetrically disposed on package 10 and the magnetic valve can be configured in other than a generally tapering opening.

Flexible package 10 of FIGS. 15 and 16 can have a first sidewall 12 and a second sidewall 14 that can be joined at a perimeter 16. Other sidewalls, a bottom, a top, and the like can also be incorporated into package 10, but for simplicity the example described with respect to FIGS. 15 and 16, like the examples above, are described as having two opposing sidewalls joined about a periphery 16. As above, in the flexible package 10 the magnetic valve 22 can be described as pressure activated. When the magnetic valve 22 is closed, a fluid contained inside the interior compartment 18 can be in a first pressure state, the first pressure state being insufficient to force fluid through opening 20. This first pressure state can be considered an equilibrium pressure state, even though, in fact, the fluid may be under a measurable amount pressure. If the fluid contained inside the interior compartment 18 experiences a second, greater, pressure state that is sufficient to overcome the separable magnetically contacting state of magnetic regions 24 and 26, the second pressure state can result in non-equilibrium such that the fluid exits the flexible package 10 through opening 20. Upon the fluid experiencing a third pressure state, less than the second pressure state and insufficient to maintain separation of magnetic regions 24 and 26, the magnetic regions 24 and 26 can once again be in a separable magnetically contacting state and opening can be closed. The third pressure state then becomes a new equilibrium first pressure state for another cycle of fluid dispensing and magnetic valve operation. Again, in this manner, the magnetic valve 22 alternately permits and prevents fluid communication of the contained fluid through the opening 20.

Figure 17B:
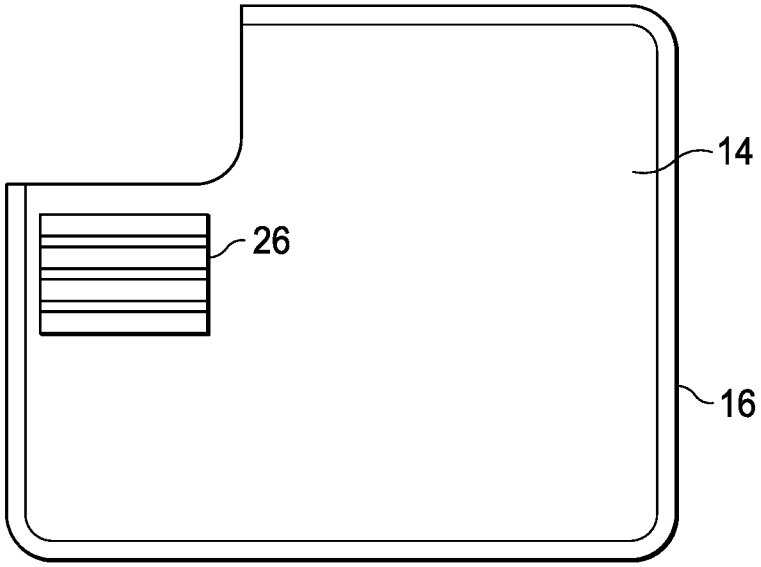
FIG. 17B is a side view of a portion of a package of the disclosure.
Figure 17A:
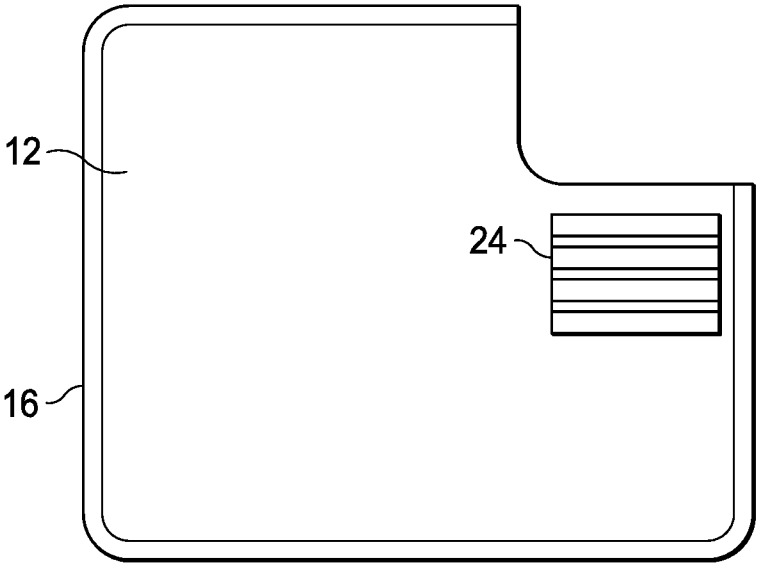
FIG. 17A is a side view of a portion of a package of the disclosure.

The example of FIGS. 15 and 16 is used herein to illustrate another advantageous feature of flexible packages 10 disclosed herein. FIG. 17A shows first sidewall 12 and magnetic region 24, which can be a printed-on magnetic ink in a predetermined pattern, which can be generally rectangular and can have bands of alternating north and south poles. FIG. 17B shows second sidewall 12 and magnetic region 26, which also can be a printed-on magnetic ink in a predetermined pattern, which can be generally rectangular and can have bands of alternating north and south poles. In general, the magnetic regions 24 and 26 can be disposed on either side of sidewalls 12 and 16, respectively. As can be understood, in the flexible package 10, the magnetic regions can be disposed on the interior of the opening 20 of the flexible package 10, or on the exterior of the opening 20 of flexible package 10. In an embodiment, one of the magnetic regions 24, 26 can be disposed on the interior of the opening 20, and the other magnetic region can be disposed on the outside of the opening 20. By placing the magnetic regions on one side or the other of the sidewalls, magnetic attracting force can be affected, either increasing or decreasing the magnetic force as desired. Likewise, if magnetic ink is utilized, the magnetic ink can be applied in a pattern and can include colors, such that the magnetic regions can be visibly incorporated into the flexible package print design. The magnetic region can also be over printed with any desired color scheme to maintain a consistent package design.

Figure 18:
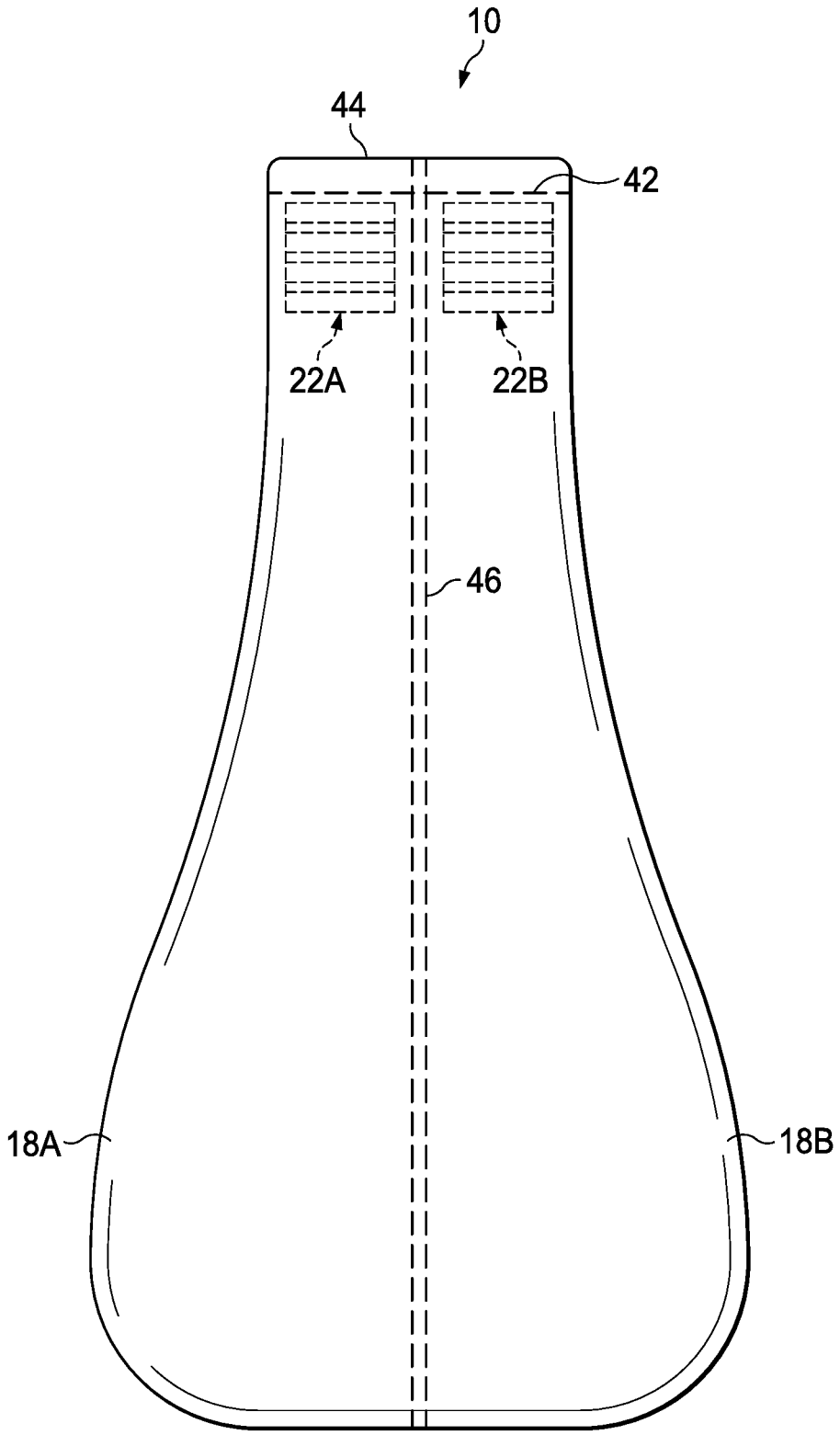
FIG. 18 is side view of a package of the disclosure.
Figure 19:
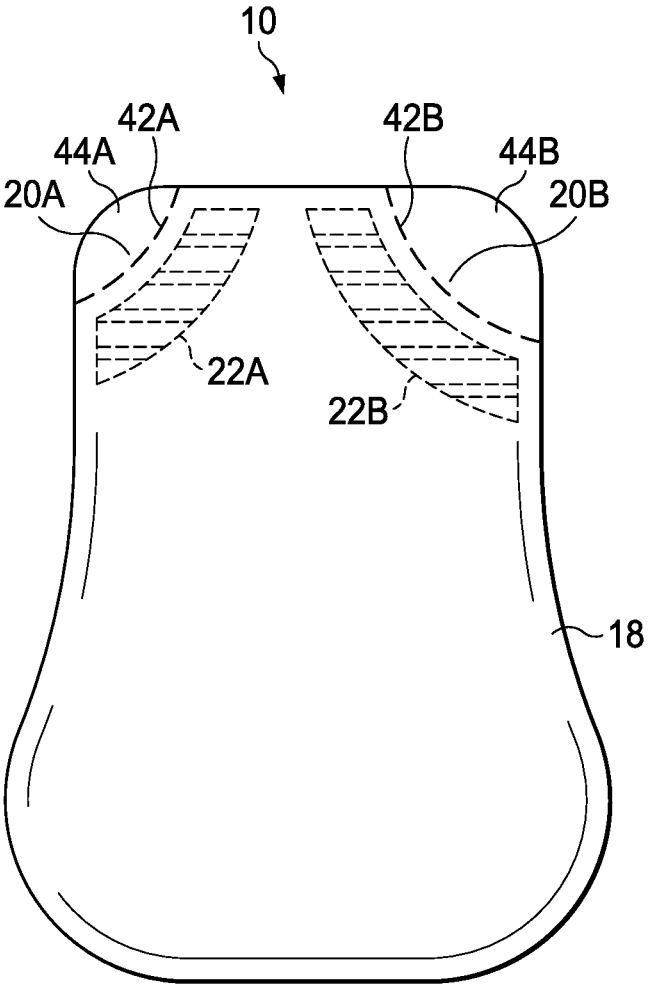
FIG. 19 is side view of a package of the disclosure.

A package 10 of the present disclosure can have more than one magnetic valve. In embodiments two or more magnetic valves can be utilized. In an embodiment, package 10 can have two or more separate interior compartments, and each compartment can have a magnetic valve. FIGS. 18 and 19 illustrate two such non-limiting embodiments. The package of FIG. 18 can be a two-compartment package 10, for dispensing two-part epoxy materials or detergent and fabric softener, for example. In the embodiment illustrated in FIG. 18, package 10 can have two interior compartments 18A and 18B separated by a seam 46, which can be a heat-sealed divider between interior compartments 18A and 18B. Each compartment can have a magnetic valve, and, as illustrated, interior compartment 18A can have a magnetic valve 22A and interior compartment 18B can have a magnetic valve 22B. As discussed above, a package 10 can have a frangible portion 44 that can be removed via a line of weakness 42, such as a perforated line.

In FIG. 19 there is shown a package 10 having a single interior compartment 18, but having two dispensing openings 20A, 20B, having magnetic valves 22A and 22B, respectively. Likewise two openings 20A and 20B can each have frangible portions 44A and 44B that can be removed via a lines of weakness 42A and 42B, such as a perforated lines.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for dispensing a fluent material contained in the package, the package comprising:

a first polymeric sidewall having a first perimeter and a second polymeric sidewall having a second perimeter, the first and second polymeric sidewalls being joined at least along a portion of the first and second perimeters and defining a flexible pouch having a first interior compartment for a contained fluent material in an equilibrium pressure state and a first opening, the first opening permitting fluid communication through the first opening upon the contained fluent material being in a positive pressure state greater than the equilibrium pressure state;

the first opening comprising a first magnetic valve, the first magnetic valve comprising a first magnetic region comprising a first deposit of magnetic ink disposed on a first portion of the first polymeric sidewall and an opposing second magnetic region comprising second deposit of magnetic ink disposed on a second portion of the second polymeric sidewall; and the first magnetic region and second magnetic region being in a separable magnetically contacting state to alternately permit and prevent fluid communication of the contained fluid through the first magnetic valve of the first opening, wherein the first and second magnetic regions comprise a plurality of parallel spaced apart magnetic bands of alternating north and south poles with the plurality defining a first poles-per-inch value at a proximal portion of the opening and a second poles-per-inch value at a distal portion of the opening, wherein the first poles-per-inch value is greater than the second poles-per-inch value.

2. The package of claim 1, wherein the adjacent north and south poles are separated by a neutral zone.

3. The package of claim 1, wherein the magnetic ink is a UV-curable magnetic ink.

4. The package of claim 1, further comprising a removable frangible portion, the frangible portion sealing the first opening.

5. The package of claim 1, further comprising a second opening, the second opening comprising a second magnetic valve, the second magnetic valve comprising a third magnetic region comprising a third deposit of magnetic ink disposed on a third portion of the first polymeric sidewall and an opposing fourth magnetic region comprising a fourth deposit of magnetic ink disposed on a fourth portion of the second polymeric sidewall, and wherein the third magnetic region and fourth magnetic region are in a separable magnetically contacting state to alternately permit and prevent fluid communication of the contained fluid through the second magnetic valve of the second opening.

6. The package of claim 5, wherein the package comprises a sealed divider defining a second interior compartment, and wherein the first magnetic valve is in the first interior compartment, and the second magnetic valve is in the second interior compartment.

7. A package for dispensing a fluent material contained in the package, the package comprising:

at least a first polymeric sidewall having a first perimeter and a second polymeric sidewall having a second perimeter, the first and second polymeric sidewalls being joined at least along a portion of the first and second perimeters and defining a flexible pouch having an interior compartment for a contained fluent material in an equilibrium pressure state and an opening, the opening permitting the fluid communication through the opening upon the contained fluent material being in a positive pressure state greater than the equilibrium pressure state;

the opening comprising a frangible portion sealing the flexible pouch;

the opening further comprising a magnetic valve between the frangible portion and the interior compartment, the magnetic valve comprising a first magnetic region comprising a first deposit of magnetic ink disposed on a first portion of the first polymeric sidewall and an opposing second magnetic region comprising second deposit of magnetic ink disposed on a second portion of the second polymeric sidewall; and the first magnetic region and second magnetic region being in a separable magnetically contacting state to alternately permit and prevent fluid communication of the contained fluent material through the magnetic valve of the opening when the frangible portion is removed, wherein the first and second magnetic regions comprise a magnetic flux gradient.

8. The package of claim 7, wherein the first and second magnetic regions comprise a plurality of parallel spaced apart magnetic bands of alternating north and south poles.

9. The package of claim 7, wherein the first and second magnetic regions comprise a plurality of parallel spaced apart magnetic bands of alternating north and south poles, with the adjacent north and south poles being separated by a neutral zone.

10. The package of claim 7, wherein the magnetic ink is a UV-curable magnetic ink.

11. The package of claim 7, wherein the magnetic flux gradient produces a greater magnetic force at a distal portion of the opening.

12. A package for dispensing a fluent material contained in the package, the package comprising:

at least a first polymeric sidewall having a first perimeter and a second polymeric sidewall having a second perimeter, the first and second polymeric sidewalls being joined at least along a portion of the first and second perimeters and defining a flexible pouch having an interior compartment for a contained fluent material and an opening, the opening permitting fluid communication with the interior compartment;

the opening comprising a magnetic valve, the magnetic valve comprising a first magnetic region comprising a magnetic flux gradient on a first portion of the first polymeric sidewall and an opposing second magnetic region comprising a second magnetic flux gradient disposed on a second portion of the second polymeric sidewall; and the first magnetic region and second magnetic region being in a variable magnetic force and being in a separable magnetically contacting state to alternately permit and prevent fluid communication of the contained fluent material through the magnetic valve of the opening, wherein the first and second magnetic regions comprise a magnetic material having a thickness dimension and a length dimension, and the thickness dimension varies across the length dimension.

13. The package of claim 12, wherein the first and second magnetic regions comprise a plurality of parallel spaced apart magnetic bands of alternating north and south poles with the plurality defining a first poles-per-inch value at a proximal portion of the opening and a second poles-per-inch value at a distal portion of the opening, wherein the first poles-per-inch value is greater than the second poles-per-inch value.

14. The package of claim 12, wherein the thickness dimension varies across the length dimension with the greatest thickness dimension near a midpoint of the length dimension.

15. The package of claim 12, wherein the magnetic flux gradient produces a greater magnetic force at a distal portion of the opening.

16. The package of claim 12, wherein the first and second magnetic regions comprise a magnetic ink.

17. The package of claim 12, further comprising a removable frangible portion, the frangible portion sealing the opening.

* * * * *